US009027362B2

(12) United States Patent
Sugitani et al.

(10) Patent No.: US 9,027,362 B2
(45) Date of Patent: May 12, 2015

(54) TURBO COMPRESSOR AND TURBO REFRIGERATOR

(75) Inventors: Noriyasu Sugitani, Yokohama (JP); Katsuya Fujisaku, Yokohama (JP)

(73) Assignee: IHI Corporation (JP)

( * ) Notice: Subject to any disclaimer, the term of this patent is extended or adjusted under 35 U.S.C. 154(b) by 324 days.

(21) Appl. No.: 13/079,915

(22) Filed: Apr. 5, 2011

(65) Prior Publication Data

US 2011/0239694 A1 Oct. 6, 2011

(30) Foreign Application Priority Data

Apr. 6, 2010 (JP) ..... P2010-087859

(51) Int. Cl.

| | |
|---|---|
| ***F25B 1/00*** | (2006.01) |
| ***F04D 29/62*** | (2006.01) |
| ***F25B 1/04*** | (2006.01) |
| ***F04D 25/04*** | (2006.01) |
| ***F04D 25/06*** | (2006.01) |
| ***F04D 29/42*** | (2006.01) |

(52) U.S. Cl.

CPC ..... *F04D 29/624* (2013.01); *F25B 1/04* (2013.01); *F04D 25/04* (2013.01); *F04D 25/0606* (2013.01); *F04D 29/4206* (2013.01)

(58) Field of Classification Search

CPC ..... H02K 5/24; H02K 5/22; F25B 1/04
USPC ..... 62/508, 498, 402, 500, 510; 415/100, 415/104, 107

See application file for complete search history.

(56) References Cited

U.S. PATENT DOCUMENTS

| | | | | |
|---|---|---|---|---|
| 1,471,834 | A * | 10/1923 | Defibaugh | 310/71 |
| 2002/0039532 | A1* | 4/2002 | Saito et al. | 417/310 |
| 2005/0069423 | A1 | 3/2005 | Ebara et al. | 417/313 |
| 2006/0090488 | A1* | 5/2006 | Hwang | 62/175 |
| 2009/0193845 | A1* | 8/2009 | Sugitani | 62/510 |

FOREIGN PATENT DOCUMENTS

| | | | |
|---|---|---|---|
| CN | 1940298 | A | 4/2007 |
| CN | 101230856 | A | 7/2008 |
| CN | 101504009 | A | 8/2009 |
| CN | 101963161 | A | 2/2011 |
| EP | 1 257 038 | A1 | 11/2002 |

(Continued)

OTHER PUBLICATIONS

Office Action dated Feb. 28, 2013 issued in corresponding Chinese Patent Application No. 201110083419.4 with English translation.

(Continued)

*Primary Examiner* — Cassey D Bauer
(74) *Attorney, Agent, or Firm* — Ostrolenk Faber LLP

(57) ABSTRACT

Provided is a turbo compressor that includes: a compressor unit compressing a gas; a motor driving the compressor unit; and a motor casing accommodating the motor. In the turbo compressor, the motor casing includes: a body portion which is molded in a cylindrical shape; an annular diameter reduced portion which is connected to at least one end portion of the body portion in the rotation axis direction of the motor and of which the diameter is reduced as it moves away from the body portion; and a flat portion which is connected to the central end portion of the diameter reduced portion and is molded in a planar shape.

9 Claims, 4 Drawing Sheets

(56) References Cited

FOREIGN PATENT DOCUMENTS

| | | |
|---|---|---|
| JP | 04-014450 | 2/1992 |
| JP | 05-015658 | 2/1993 |
| JP | 5-256262 | 10/1993 |
| JP | 06-121482 | 4/1994 |
| JP | 07-035074 | 2/1995 |
| JP | 07-336926 | 12/1995 |
| JP | 08-047204 | 2/1996 |
| JP | 10-112959 | 4/1998 |
| JP | 10-141293 | 5/1998 |
| JP | 11-252852 | 9/1999 |
| JP | 2000-329095 | 11/2000 |
| JP | 2001-355591 | 12/2001 |
| JP | 2003-224947 | 8/2003 |
| JP | 2004-040860 | 2/2004 |
| JP | 2005-006399 | 1/2005 |
| JP | 2009-185713 | 8/2009 |

OTHER PUBLICATIONS

Office Action dated Dec. 20, 2013 issued in corresponding Japanese Patent Application No. 2010-087859 with English translation.

* cited by examiner

TURBO COMPRESSOR AND TURBO REFRIGERATOR

BACKGROUND OF THE INVENTION

1. Field of the Invention

The present invention relates to a turbo compressor and a turbo refrigerator.

Priority is claimed on Japanese Patent Application No. 2010-087859, filed Apr. 6, 2010, the content of which is incorporated herein by reference.

2. Background Art

As a refrigerator cooling or freezing a cooling object such as water, there has been known a turbo refrigerator including a turbo compressor compressing and discharging a refrigerant gas. As disclosed in Japanese Patent Application, First publication No. 2009-185713, the turbo compressor is provided with an impeller rotationally driven by a motor and the refrigerant gas is compressed through the rotation of the impeller. In addition, the motor is accommodated in a motor casing.

Here, the motor casing includes a body portion molded in a cylindrical shape and a blocking cover molded in a planar shape and blocking both ends of the body portion. However, since the blocking cover is molded in a planar shape, there is a concern that the blocking cover resonates with the operation of the motor. In particular, if the resonance is generated in the blocking cover when the motor is operated at a specific rpm, there is a concern that noise increases or the motor casing is damaged. That is, it is difficult to increase the rpm of the motor up to a value equal to or higher than the specific rpm. Accordingly, in the turbo compressor and the turbo refrigerator of the related art, it is difficult to stably operate the motor at a high rpm.

The invention is made in view of such circumstances, and an object thereof is to provide a turbo compressor capable of stably operating a motor at a high rpm and a turbo refrigerator having the turbo compressor.

SUMMARY OF THE INVENTION

In order to solve the above-described problems, the invention adopts the following configurations.

(1) A turbo compressor of the invention is a turbo compressor that includes a compressor unit compressing a gas, a motor driving the compressor unit, and a motor casing accommodating the motor. In the turbo compressor, the motor casing includes a body portion which is molded in a cylindrical shape, an annular diameter reduced portion which is connected to at least one end portion of the body portion in the rotation axis direction of the motor and of which the diameter is reduced as it moves away from the body portion, and a flat portion which is connected to the central end portion of the diameter reduced portion and is molded in a planar shape.

According to the turbo compressor of the invention, since the reduced diameter portion is provided, the diameter of the flat portion is smaller than that of the related art. For this reason, the natural frequency of the flat portion increases, so that the vibration frequency when generating the resonance of the flat portion increases. Since the resonance is generated in response to the rpm of the motor, the rpm of the motor when generating the resonance of the flat portion increases more than the related art.

(2) The motor may include an output shaft outputting a drive force driving the compressor, the motor casing may include a support portion provided at the flat portion and rotatably supporting the output shaft, and the support portion may protrude from the flat portion toward the motor.

(3) The flat portion may include a plurality of reinforcement portions extending in the radial direction.

(4) A turbo refrigerator of the invention includes: a condenser which cools and liquefies a compressed refrigerant; an evaporator which cools a cooling object by evaporating the liquefied refrigerant and taking evaporation heat from the cooling object; and a compressor which compresses the refrigerant evaporated by the evaporator and supplies the compressed refrigerant to the condenser. The turbo compressor according to (1) is used as the compressor of the turbo refrigerator.

According to the invention, the rpm of the motor when generating the resonance of the flat portion increases more than the related art. For this reason, it is possible to stably operate the motor at a high rpm compared to the related art.

DETAILED DESCRIPTION OF THE INVENTION

Hereinafter, an exemplary embodiment of the invention will be described by referring to FIGS. 1 to 4. In the respective drawings used for the following description, the scales of the respective members are appropriately changed so that the respective members have recognizable sizes.

Figure 1:
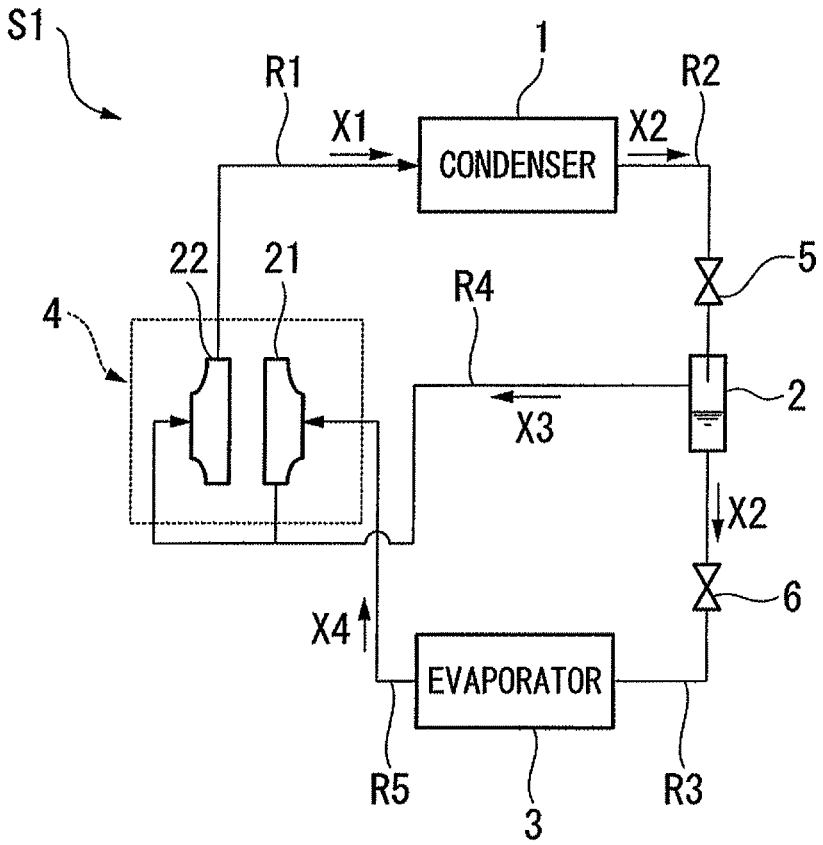
FIG. 1 is a block diagram illustrating a schematic configuration of a turbo refrigerator of an embodiment of the invention.

FIG. 1 is a block diagram illustrating a schematic configuration of a turbo refrigerator S1 of the embodiment. The turbo refrigerator S1 of the embodiment is provided at, for example, a building, a factory, or the like in order to generate air-conditioning cooling water. As shown in FIG. 1, the turbo refrigerator S1 includes a condenser 1, an economizer 2, an evaporator 3, and a turbo compressor 4.

A compressed refrigerant gas X1 as a compressed gas refrigerant is supplied to the condenser 1, and the compressed refrigerant gas X1 is cooled and liquefied so that it becomes a refrigerant liquid X2. Further, as shown in FIG. 1, the condenser 1 is connected to the turbo compressor 4 through a passage R1 where the compressed refrigerant gas X1 flows, and is connected to the economizer 2 through a passage R2 where the refrigerant liquid X2 flows. An expansion valve 5 is provided in the passage R2 so as to depressurize the refrigerant liquid X2.

The economizer 2 temporarily stores the refrigerant liquid X2 depressurized at the expansion valve 5. The economizer 2 is connected to the evaporator 3 through a passage R3 where the refrigerant liquid X2 flows, and is connected to the turbo compressor 4 through a passage R4 where a gas phase component X3 of the refrigerant generated at the economizer 2 flows. An expansion valve 6 is provided at the passage R3 so as to further depressurize the refrigerant liquid X2. Further, the passage R4 is connected to the turbo compressor 4 so as to supply the gas phase component X3 to a second compression stage 22 described later and provided in the turbo compressor 4.

The evaporator 3 cools a cooling object by taking evaporation heat from the cooling object such as water in a manner such that the refrigerant liquid X2 evaporates. The evaporator 3 is connected to the turbo compressor 4 through a passage R5 where a refrigerant gas X4 generated by the evaporation of the refrigerant liquid X2 flows. The passage R5 is connected to a first compression stage 21 described later and provided in the turbo compressor 4.

The turbo compressor 4 compresses the refrigerant gas X4 so that it becomes the compressed refrigerant gas X1. As described above, the turbo compressor 4 is connected to the condenser 1 through the passage R1 where the compressed refrigerant gas X1 flows, and is connected to the evaporator 3 through the passage R5 where the refrigerant gas X4 flows.

In the turbo refrigerator S1 having the above-described configuration, the compressed refrigerant gas X1 supplied to the condenser 1 through the passage R1 is cooled and liquefied by the condenser 1 so that it becomes the refrigerant liquid X2. The refrigerant liquid X2 is depressurized by the expansion valve 5 when it is supplied to the economizer 2 through the passage R2, and is temporarily stored in a depressurized state at the economizer 2. Subsequently, the refrigerant liquid X2 is further depressurized by the expansion valve 6 when it is supplied to the evaporator 3 through the passage R3, and is supplied to the evaporator 3 in a further depressurized state. The refrigerant liquid X2 supplied to the evaporator 3 is evaporated by the evaporator 3 so that it becomes the refrigerant gas X4, and is supplied to the turbo compressor 4 through the passage R5. The refrigerant gas X4 supplied to the turbo compressor 4 is compressed by the turbo compressor 4 so that it becomes the compressed refrigerant gas X1, and is supplied again to the condenser 1 through the passage R1. Further, a gas phase component X3 of the refrigerant is generated when the refrigerant liquid X2 is stored in the economizer 2. The gas phase component X3 is supplied to the turbo compressor 4 through the passage R4, and is compressed together with the refrigerant gas X4 so that it is supplied as the compressed refrigerant gas X1 to the condenser 1 through the passage R1.

Then, in the turbo refrigerator S1, the cooling object is cooled or frozen in a manner such that the refrigerant liquid X2 takes evaporation heat from the cooling object when evaporating from the evaporator 3.

Figure 2:
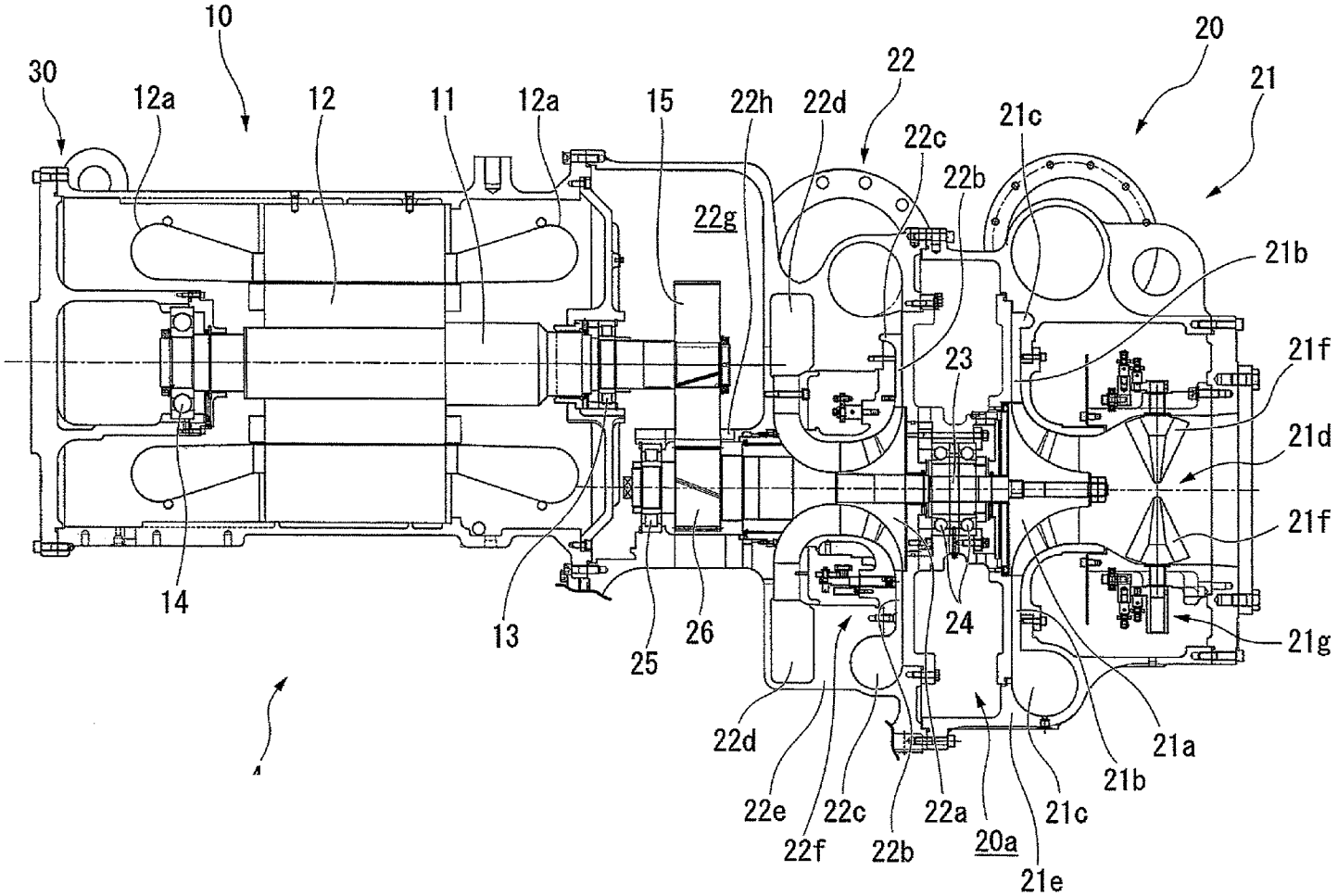
FIG. 2 is a horizontal cross-sectional view illustrating a turbo compressor of the embodiment of the invention.

Next, the turbo compressor 4 will be described in more detail. FIG. 2 is a horizontal cross-sectional view illustrating the turbo compressor 4 of the embodiment. As shown in FIG. 2, the turbo compressor 4 of the embodiment includes a motor unit 10 and a compressor unit 20 (a compressor).

The motor unit 10 includes a motor 12 which includes an output shaft 11 and serves as a drive source driving the compressor unit 20, and a motor casing 30 which surrounds the motor 12 and in which the motor 12 is provided. A coil end 12*a* protrudes from both sides of the motor 12 in the axial direction of the output shaft 11.

The output shaft 11 of the motor 12 is rotatably supported by a first bearing 13 and a second bearing 14 provided in the motor casing 30. The end portion of the output shaft 11 at the side of the first bearing 13 protrudes from the motor casing 30, and a spur gear 15 is fixed to the end portion thereof. The spur gear 15 transmits the drive force of the motor 12 to the compressor unit 20.

The compressor unit 20 includes the first compression stage 21 which suctions and compresses the refrigerant gas X4 (refer to FIG. 1), and the second compression stage 22 which further compresses the refrigerant gas X4 compressed at the first compression stage 21 and discharges it as the compressed refrigerant gas X1 (refer to FIG. 1).

The first compression stage 21 includes a first impeller 21*a* which discharges the refrigerant gas X4 in the radial direction by applying velocity energy to the refrigerant gas X4 supplied in the thrust direction, a first diffuser 21*b* which compresses the refrigerant gas X4 by converting the velocity energy applied to the refrigerant gas X4 into pressure energy by the first impeller 21*a*, a first scroll chamber 21*c* which guides the refrigerant gas X4 compressed by the first diffuser 21*b* to the outside of the first compression stage 21, and a suction port 21*d* which supplies the refrigerant gas X4 to the first impeller 21*a* by suctioning the refrigerant gas X4. The first diffuser 21*b*, the first scroll chamber 21*c*, and the suction port 21*d* are formed by a first compressor casing 21*e* surrounding the first impeller 21*a*.

A rotation shaft 23 is provided inside the compressor unit 20 so as to extend across the first compression stage 21 and the second compression stage 22. The first impeller 21*a* is fixed to the rotation shaft 23, and rotates when a drive force is transmitted from the motor 12 to the rotation shaft 23.

A plurality of inlet guide vanes 21*f* is provided in the suction port 21*d* of the first compression stage 21 so as to adjust the suction amount of the first compression stage 21. Each inlet guide vane 21*f* is rotatably supported by the drive mechanism 21*g* fixed to the first compressor casing 21*e* so that a visible area in the stream direction of the refrigerant gas X4 is changeable. Further, a vane drive unit (not shown) is provided at the outside of the first compressor casing 21*e* so that the vane drive unit is connected to the drive mechanism 21*g* and rotationally drives each inlet guide vane 21*f*.

The second compression stage 22 includes a second impeller 22*a* which discharges the refrigerant gas X4 in the radial direction by applying velocity energy to the refrigerant gas X4 compressed at the first compression stage 21 and supplied in the thrust direction, a second diffuser 22*b* which compresses and discharges the compressed refrigerant gas X1 by converting the velocity energy applied to the refrigerant gas X4 into pressure energy by the second impeller 22*a*, a second scroll chamber 22*c* which guides the compressed refrigerant gas X1 discharged from the second diffuser 22*b* to the outside of the second compression stage 22, and an introduction scroll chamber 22*d* which guides the refrigerant gas X4 compressed by the first compression stage 21 to the second impeller 22*a*. The second diffuser 22*b*, the second scroll chamber 22*c*, and the introduction scroll chamber 22*d* are formed by a second compressor casing 22*e* surrounding the second impeller 22*a*.

The second impeller 22*a* is fixed to the rotation shaft 23 so that the rear surface thereof is coupled to the rear surface of the first impeller 21*a*, and rotates when a drive force is transmitted from the motor 12 to the rotation shaft 23. The second scroll chamber 22*c* is connected to the passage R1 (refer to FIG. 1) supplying the compressed refrigerant gas X1 to the condenser 1 (refer to FIG. 1), and supplies the compressed refrigerant gas X1 guided from the second compression stage 22 to the passage R1.

The second compression stage 22 is provided with a flow rate control unit 22*f* which adjusts the flow rate of the compressed refrigerant gas X1 obtained by compressing the refrigerant gas X4 in the second diffuser 22*b*. The flow rate control unit 221 is provided so as to surround the second impeller 22*a* so that the flow rate control unit 22 may adjust the width of the passage of the second diffuser 22*b*. That is, since the inlet guide vane 21*f* or the flow rate control unit 22*f* adjusts the flow rate of the refrigerant gas X4 or the compressed refrigerant gas X1 flowing inside the compressor unit 20, the compressing performance of the turbo compressor 4, that is, the freezing performance of the turbo refrigerator S1 (refer to FIG. 1) may be adjusted.

In addition, the first scroll chamber 21*c* of the first compression stage 21 and the introduction scroll chamber 22*d* of the second compression stage 22 are connected to each other through an external pipe (not shown) that is provided separately from the first compression stage 21 and the second compression stage 22. The refrigerant gas X4 compressed at the first compression stage 21 is supplied to the second compression stage 22 through the external pipe. The passage R4 (refer to FIG. 1) is connected to the external pipe, and the gas phase component X3 of the refrigerant generated at the economizer 2 is supplied to the second compression stage 22 through the external pipe.

The rotation shaft 23 is rotatably supported in a first space 20*a* between the first compression stage 21 and the second compression stage 22 through a third bearing 24 provided in the second compressor casing 22*e* and a fourth bearing 25 provided at the side of the motor unit 10 in the second compressor casing 22*e*.

A second space 22*g* is formed at the side of the motor unit 10 in the second compressor casing 22*e* so as to accommodate the spur gear 15 therein. Further, a pinion gear 26 is integrally formed with the rotation shaft 23 so as to mesh with the spur gear 15. The pinion gear 26 is provided in the vicinity of the fourth bearing 25. An open portion 22*h* is formed in the vicinity of the pinion gear 26 in the second compressor casing 22*e* so as to be opened to the second space 22*g*. The spur gear 15 and the pinion gear 26 mesh with each other through the open portion 22*h*. Since the spur gear 15 and the pinion gear 26 mesh with each other, the drive force of the motor 12 may be transmitted to the rotation shaft 23.

The spur gear 15 has a larger diameter than that of the pinion gear 26, and the rotation power of the motor 12 is transmitted to the rotation shaft 23 so that the rpm of the rotation shaft 23 increases with respect to the rpm of the output shaft 11 by the cooperation between the spur gear 15 and the pinion gear 26. In addition, the method of transmitting the rotation power of the motor 12 is not limited thereto. For example, a plurality of gears may have different diameters so that the rpm of the rotation shaft 23 is equal to or lower than the rpm of the output shaft 11.

Figure 3A:
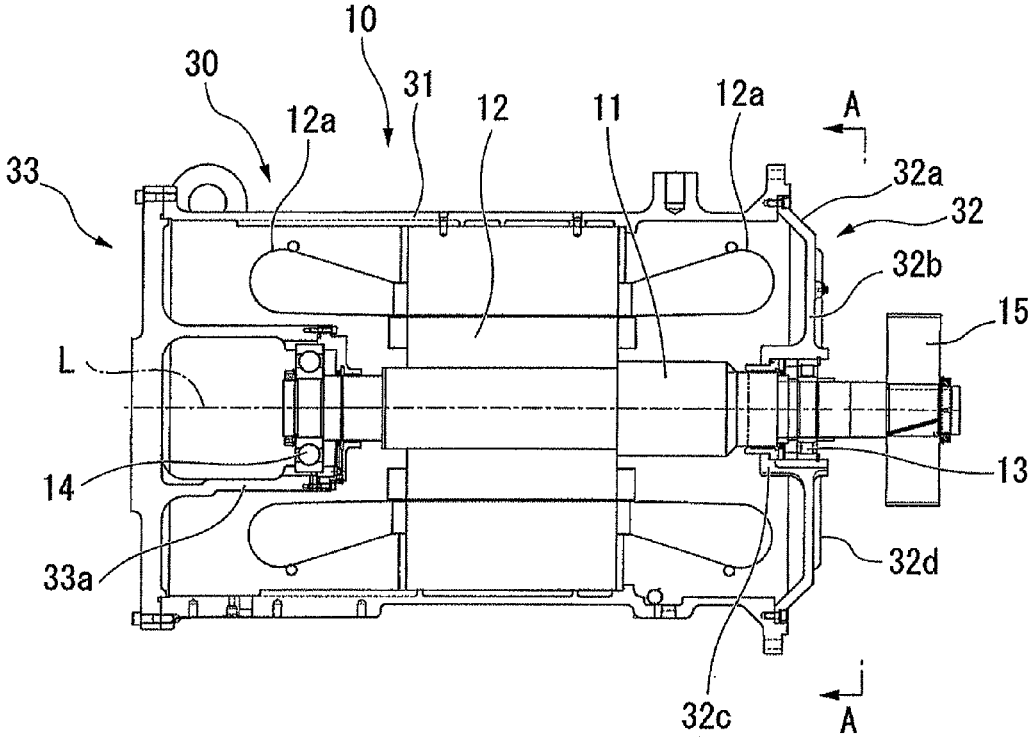
FIG. 3A is a schematic diagram illustrating a motor unit of the embodiment of the invention.
Figure 3B:
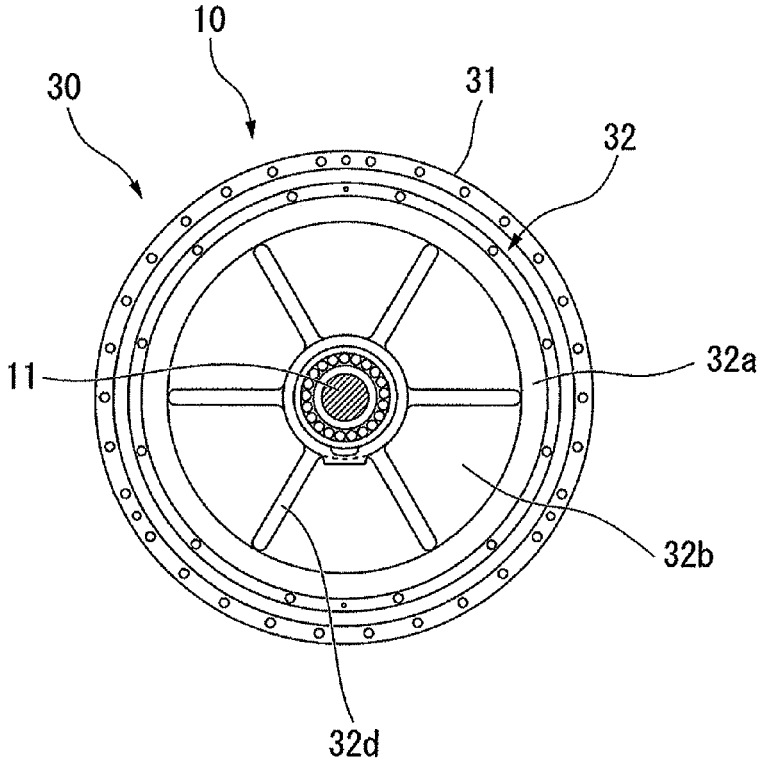
FIG. 3B is a schematic diagram illustrating the motor unit of the embodiment of the invention.

Next, the characteristic motor unit 10 of the embodiment will be described in detail. FIGS. 3A and 3B are schematic diagram illustrating the motor unit 10 of the embodiment. FIG. 3A is a horizontal cross-sectional view and FIG. 3B is a cross-sectional view taken along the line A-A of FIG. 3A. Further, in FIGS. 3A and 3B, the axis of the output shaft 11 is indicated by the reference numeral L. As described above, the motor 12 is accommodated in the motor casing 30. The motor casing 30 includes a body portion 31, a first blocking cover 32, and a second blocking cover 33.

The body portion 31 is a member molded in a cylindrical shape, and is manufactured by, for example, casting. The motor 12 is rotatably accommodated at the inside of the body portion 31 in the radial direction. The first blocking cover 32 and the second blocking cover 33 are members respectively blocking both open end portions of the body portion 31 in the direction of the axis L. Further, the first blocking cover 32 is fixed to the end portion at the side of the spur gear 15 in the body portion 31.

The first blocking cover 32 is a cover blocking the open end portion at the side of the spur gear 15 in the body portion 31. In the first blocking cover 32, a reduced diameter portion 32*a*, a flat portion 32*b*, and a first support portion 32*c* (a support portion) are integrally molded with each other by, for example, casting. The reduced diameter portion 32*a* is an annular member which is connected to the end portion of the body portion 31 and of which the diameter reduces as it moves away from the body portion 31 (toward the spur gear 15). That is, the reduced diameter portion 32*a* is molded in a tapered shape of which the diameter gradually reduces in the radial direction of the body portion 31. Further, the first blocking cover 32 is fixed to the body portion 31 by a screw member such as a bolt provided at the outer peripheral edge portion of the reduced diameter portion 32*a*.

Since the reduced diameter portion 32*a* is molded in a tapered shape, it is possible to easily perform a process of connecting the motor unit 10 to the second compressor casing 22*e* of the compressor unit 20 by using the reduced diameter portion 32*a*. As shown in FIG. 2, the spur gear 15 and the pinion gear 26 mesh with each other through the open portion 22*h*. For this reason, the following operation is needed to connect the motor unit 10 to the second compressor casing 22*e*. First, the motor unit 10 is moved close to the second compressor casing 22*e* in the axial direction of the output shaft 11, so that the spur gear 15 is accommodated in the second space 22*g*. Subsequently, the motor unit 10 is moved in the direction perpendicular to the axial direction, so that the spur gear 15 meshes with the pinion gear 26.

However, in the embodiment, since there is provided the reduced diameter portion 32*a* molded in a tapered shape, it is possible to largely (sufficiently) ensure the movement amount of the motor unit 10 in the direction perpendicular to the axial direction so that the spur gear 15 is smoothly accommodated in the second space 22*g*. Further, the end portion at the side of the motor unit 10 in the second compressor casing 22*e* is brought into contact with the reduced diameter portion 32*a*, so that the reduced diameter portion 32*a* is used as a guide. Accordingly, it is possible to easily perform a process of allowing the spur gear 15 to mesh with the pinion gear 26 through the open portion 22*h*. Therefore, it is possible to easily perform a process of connecting the motor unit 10 to the second compressor casing 22*e*.

Returning to FIGS. 3A and 3B, the flat portion 32*b* is a member molded in a planar shape and connected to the central end portion of the reduced diameter portion 32*a*. The flat portion 32*b* is connected to the reduced diameter portion 32*a* in a posture perpendicular to the axis L. Since the reduced diameter portion 32*a* is provided between the flat portion 32*b* and the body portion 31, the diameter of the flat portion 32*b* is smaller than the diameter of the body portion 31. Further, since the reduced diameter portion 32*a* is provided, the flat portion 32*b* is provided at a position deviated from the body portion 31. For this reason, a larger gap than that of the related art is formed between the coil end 12*a* of the motor 12 and the flat portion 32*b*. Accordingly, for example, even when a large motor having a long coil end is accommodated in the motor casing 30, it is possible to accommodate a larger motor without changing the specification of the motor casing 30. A plurality of ribs 32*d* (reinforcement portions) is formed on the surface at the side of the spur gear 15 in the flat portion 32*b* so as to extend in the radial direction.

The first support portion 32*c* rotatably supports the output shaft 11 through the first bearing 13. The first support portion 32*c* is provided at the flat portion 32*b* and is formed in a cylindrical shape so that the output shaft 11 penetrates the center thereof. The first bearing 13 is disposed at the inner peripheral surface side of the first support portion 32*c*. That is, the first blocking cover 32 having the first support portion 32*c* rotatably supports the output shaft 11 through the first bearing 13. The first support portion 32*c* protrudes from the flat portion 32*b* toward the motor 12. Since the first support portion 32*c* protrudes toward the motor 12, it is possible to provide the first bearing 13 toward at the near side of the motor 12, and to shorten a distance between the first bearing 13 and the second bearing 14 in the output shaft 11. Accordingly, it is possible to suppress vibration or vibration-rotation of the output shaft 11 during the operation of the motor 12. Further, since the vibration or the vibration-rotation of the output shaft 11 is suppressed, it is possible to operate the motor 12 at a higher rpm.

The second blocking cover 33 is a cover blocking the opening end portion at the opposite side of the spur gear 15 in the body portion 31. The second blocking cover 33 is molded in a planar shape perpendicular to the axis L and is fixed to the end portion of the body portion 31 by a screw member such as a bolt. The second blocking cover 33 is provided with a second support portion 33*a* rotatably supporting the output shaft 11 through the second bearing 14. The second support portion 33*a* protrudes toward the motor 12.

Next, an action of the resonance of the first blocking cover 32 will be described. As described above, since the reduced diameter portion 32*a* is provided between the flat portion 32*b* and the body portion 31, the diameter of the flat portion 32*b* is smaller than that of the body portion 31. That is, since the reduced diameter portion 32*a* is provided, the diameter of the flat portion 32*b* in the first blocking cover 32 is smaller than that of the related art. Accordingly, since the diameter of the flat portion 32*b* decreases, the natural frequency of the flat portion 32*b* increases. The flat portion 32*b* is vibrated with the rotation of the motor 12. When the motor 12 is operated at a specific rpm, resonance of the flat portion 32*b* is generated. However, since the natural frequency of the flat portion 32*b* increases, the frequency of the vibration when generating the resonance of the flat portion 32*b* increases more than the related art.

As described above, since the resonance is generated in response to the rpm of the motor 12, the rpm of the motor 12 when generating the resonance of the flat portion 32*b* increases more than the related art. In other words, since it is possible to operate the motor 12 at a higher rpm than that of the related art without generating the resonance of the flat portion 32*b*, it is possible to stably operate the motor 12 even when the rpm is higher than that of the related art.

Figure 4:
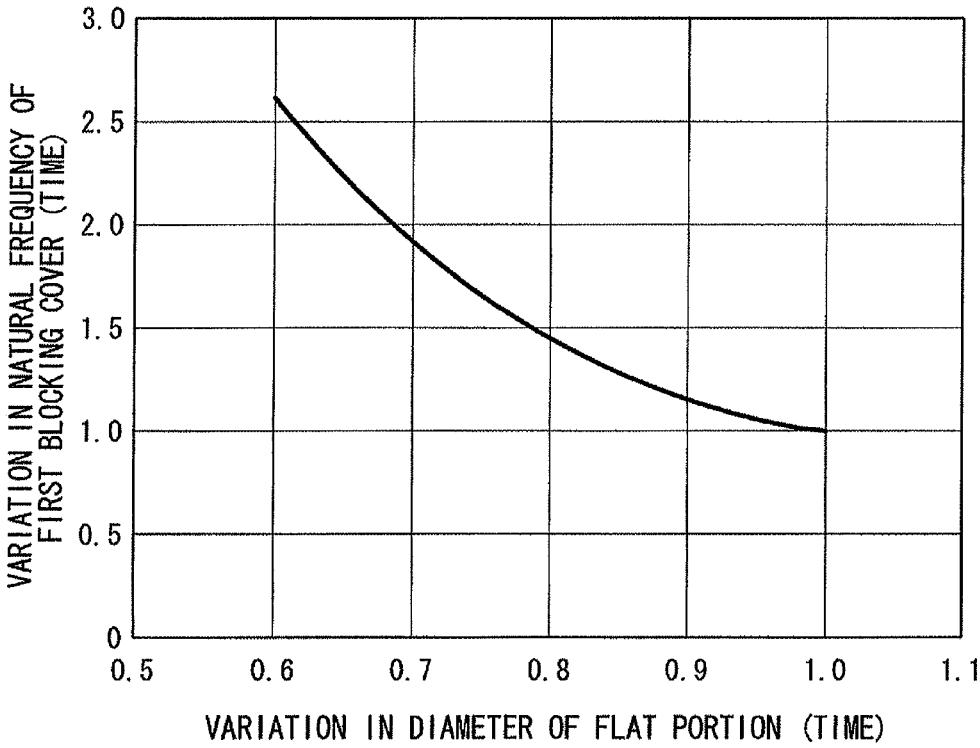
FIG. 4 is a graph illustrating a relationship between a natural frequency of a first blocking cover and a diameter of a flat portion of the embodiment of the invention.

Here, a relationship between the diameter of the flat portion 32*b* and the natural frequency of the first blocking cover 32 will be described. FIG. 4 is a graph illustrating a relationship between a natural frequency of the first blocking cover 32 and a diameter of the flat portion 32*b* of the embodiment. The horizontal axis of FIG. 4 indicates a variation in the diameter of the flat portion 32*b*. Further, the diameter of the configuration in which the diameter of the flat portion 32*b* is equal to the diameter of the body portion 31 (that is, the configuration in which the reduced diameter portion 32*a* is not present) is specified as one time. The vertical axis of FIG. 4 indicates a variation in the natural frequency of the first blocking cover 32 (the natural frequency including the reduced diameter portion 32*a*, the flat portion 32*b*, and the first support portion 32*c*). As in the horizontal axis, the natural frequency of the configuration in which the diameter of the flat portion 32*b* is equal to the diameter of the body portion 31 is specified as one time.

As shown in FIG. 4, since the reduced diameter portion 32*a* is provided, the natural frequency of the first blocking cover 32 increases as the diameter of the flat portion 32*b* decreases. For example, since the diameter of the flat portion 32*b* is only 0.7 times, the natural frequency of the first blocking cover 32 is about twice. That is, it is possible to efficiently increase the natural frequency. Further, in the embodiment, the plurality of ribs 32*d* is provided at the surface of the flat portion 32*b*. Since the rigidity of the flat portion 32*b* improves due to the ribs 32*d*, the ribs 32*d* may also increase the natural frequency of the first blocking cover 32.

Next, an operation of the turbo compressor 4 of the embodiment will be described. First, the rotation power of the motor 12 is transmitted to the rotation shaft 23 through the spur gear 15 and the pinion gear 26. Accordingly, the first impeller 21*a* and the second impeller 22*a* of the compressor unit 20 rotate.

When the first impeller 21*a* rotates, the suction portion 21*d* of the first compression stage 21 enters a negative-pressure state, the refrigerant gas X4 flows from the passage R5 into the first compression stage 21 through the suction port 21*d*. The refrigerant gas X4 flowing into the first compression stage 21 flows into the first impeller 21*a* in the thrust direction, and is discharged in the radial direction by applying velocity energy thereto by the first impeller 21*a*. The refrigerant gas X4 discharged from the first impeller 21*a* is compressed by converting velocity energy into pressure energy by the first diffuser 21*b*. The refrigerant gas X4 discharged from the first diffuser 21*b* is guided to the outside of the first compression stage 21 through the first scroll chamber 21*c*. Then, the refrigerant gas X4 guided to the outside of the first compression stage 21 is supplied to the second compression stage 22 through an external pipe (not shown).

The refrigerant gas X4 supplied to the second compression stage 22 flows into the second impeller 22*a* in the thrust direction through the introduction scroll chamber 22*d*, and is discharged in the radial direction by applying velocity energy thereto by the second impeller 22*a*. The refrigerant gas X4 discharged from the second impeller 22*a* is further compressed by converting velocity energy into pressure energy by the second diffuser 22*b*, so that it becomes the compressed refrigerant gas X1. The compressed refrigerant gas X1 discharged from the second diffuser 22*b* is guided to the outside of the second compression stage 22 through the second scroll chamber 22*c*. Then, the compressed refrigerant gas X1 guided to the outside of the second compression stage 22 is supplied to the condenser 1 through the passage R1. In this way, the operation of the turbo compressor 4 is completed.

Therefore, according to the embodiment, the rpm of the motor 12 when generating the resonance of the flat portion 32*b* increases more than the related art. For this reason, it is possible to stably operate the motor 12 at a high rpm compared to the related art.

As mentioned above, although a preferable embodiment according to the present invention has been described with reference to the drawings, it is needless to say that the present invention is not limited to the related art. Overall shapes, combinations or the like of the respective members shown in the aforementioned examples, and can be variously changed in a scope of not depending from the gist of the present invention based on the design request or the like.

For example, in the above-described embodiment, the turbo compressor 4 is provided in the turbo refrigerator S1 to compress the refrigerant gas X4, but the invention is not limited thereto. For example, the turbo compressor 4 may be used as a supercharger supplying compressed air to an internal combustion engine.

Further, in the above-described embodiment, only the first blocking cover 32 includes both the reduced diameter portion 32*a* and the flat portion 32*b*, but the invention is not limited thereto. For example, the second blocking cover 33 may include both the reduced diameter portion and the flat portion.

Further, in the above-described embodiment, the body portion 31 is molded in a cylindrical shape, but the invention is not limited thereto. For example, the body portion 31 may be molded in a quadrangular prism shape.

Further, in the above-described embodiment, the outer peripheral edge portion of the reduced diameter portion 32*a* is connected to the body portion 31, but the invention is not limited thereto. For example, the body portion 31 and the reduced diameter portion 32*a* may be integrally molded and the flat portion 32*b* may be fixed to the central end portion of the reduced diameter portion 32*a* by a screw member or the like.

What is claimed is:

1. A turbo compressor comprising:

a compressor unit which compresses a gas;

a motor which drives the compressor unit; and a motor casing which accommodates the motor, wherein the motor casing includes:

a body portion which is molded in a cylindrical shape and extends in the rotation axis direction of the motor; and a pair of blocking covers which are configured to block a pair of open end portions located at both sides of the body portion, wherein at least one of the blocking covers includes: an annular diameter reduced portion which is in direct physical contact with at least one of the pair of open end portion of the body portion, the annular diameter reduced portion having an outer diameter thereof that is reduced as it moves away from the body portion; and a flat portion which is integrally molded with the annular diameter reduced portion via a whole circumference of the central end portion of the annular diameter reduced portion and is molded in a planar shape.

2. The turbo compressor according to claim 1, wherein the motor includes an output shaft outputting a drive force driving the compressor, the motor casing includes a support portion provided at the flat portion and rotatably supporting the output shaft, and the support portion protrudes from the flat portion toward the motor.

3. The turbo compressor according to claim 1, wherein the flat portion includes a plurality of reinforcement portions extending in the radial direction.

4. The turbo compressor according to claim 2, wherein the flat portion includes a plurality of reinforcement portions extending in the radial direction.

5. A turbo refrigerator comprising:

a condenser which cools and liquefies a compressed refrigerant;

an evaporator which cools a cooling object by evaporating the liquefied refrigerant and taking evaporation heat from the cooling object; and a compressor which compresses the refrigerant evaporated by the evaporator and supplies the compressed refrigerant to the condenser, wherein the turbo compressor according to claim 1 is used as the compressor.

6. A turbo refrigerator comprising:

a condenser which cools and liquefies a compressed refrigerant;

an evaporator which cools a cooling object by evaporating the liquefied refrigerant and taking evaporation heat from the cooling object; and a compressor which compresses the refrigerant evaporated by the evaporator and supplies the compressed refrigerant to the condenser, wherein the turbo compressor according to claim 2 is used as the compressor.

7. A turbo refrigerator comprising:

a condenser which cools and liquefies a compressed refrigerant;

an evaporator which cools a cooling object by evaporating the liquefied refrigerant and taking evaporation heat from the cooling object; and a compressor which compresses the refrigerant evaporated by the evaporator and supplies the compressed refrigerant to the condenser, wherein the turbo compressor according to claim 3 is used as the compressor.

8. A turbo refrigerator comprising:

a condenser which cools and liquefies a compressed refrigerant;

an evaporator which cools a cooling object by evaporating the liquefied refrigerant and taking evaporation heat from the cooling object; and a compressor which compresses the refrigerant evaporated by the evaporator and supplies the compressed refrigerant to the condenser, wherein the turbo compressor according to claim 4 is used as the compressor.

9. The turbo compressor according to claim 1, wherein the annular diameter reduced portion includes an inclined plane which has the outer diameter thereof that is reduced as it moves away from the body portion.

* * * * *